United States Patent [19]

Ishitani et al.

[11] Patent Number: 4,567,398

[45] Date of Patent: Jan. 28, 1986

[54] LIQUID METAL ION SOURCE

[75] Inventors: Tohru Ishitani, Sayama; Hifumi Tamura, Hachioji; Akira Shimase, Yokohama, all of Japan

[73] Assignee: Hitachi, Ltd., Tokyo, Japan

[21] Appl. No.: 474,473

[22] Filed: Mar. 11, 1983

[30] Foreign Application Priority Data

Apr. 14, 1982 [JP] Japan ..... 57-61063

[51] Int. Cl.[4] ..... H05H 1/00; H01J 1/02

[52] U.S. Cl. ..... 313/362.1; 313/359.1; 313/336; 250/423 R

[58] Field of Search ..... 313/359.1, 360.1, 361.1, 313/362.1, 363.1, 232, 309, 336, 231.01; 250/423 R, 424, 423 F

[56] References Cited

U.S. PATENT DOCUMENTS

| | | | |
|---|---|---|---|
| 3,867,704 | 2/1975 | Gorka, Jr. | 313/359.1 X |
| 3,988,627 | 10/1976 | Dustmann et al. | 313/309 |
| 4,088,919 | 5/1978 | Clampitt et al. | 313/362.1 |
| 4,318,029 | 3/1982 | Jergenson | 313/232 X |

*Primary Examiner*—David K. Moore
*Assistant Examiner*—K. Wieder
*Attorney, Agent, or Firm*—Antonelli, Terry & Wands

[57] ABSTRACT

A liquid metal ion source according to the present invention has a needle electrode disposed at a position spaced from a reservoir for holding a source material, and is provided with means for freely varying a distance from the reservoir to the fore end of the needle electrode.

2 Claims, 2 Drawing Figures

LIQUID METAL ION SOURCE

BACKGROUND OF THE INVENTION

The present invention relates to improvements in a liquid metal ion source for use in an ion microanalyzer, an ion implanter, an ion beam writing apparatus, etc.

The liquid metal ion source is a point source of high brightness, and has characteristics desirable for enhancing the performance of ion beam application systems. The fundamental structure and operating principle of such ion source are described in detail in Japanese Laid-open Patent Application No. 52-125998 (corresponding to U.S. Pat. No. 4,088,919). As shown in FIG. 1, the fundamental structure of the liquid metal ion source consists of a needle tip 1, a source material 2, a reservoir 3' for the source material 2, and an extractor 4. While the reservoir 3' for the source material 2 is in the shape of a hairpin, a ribbon, a pipe or the like, FIG. 1 illustrates the pipe-shaped reservoir 3'. The reservoir 3' for the source material 2 is subjected to resistor heating or electron bombardment heating in vacuum, and the source material 2 is thus held liquid. When, in this state, the fore end of the needle tip 1 is sufficiently wetted and a positive high voltage is applied to the needle tip or a negative high voltage to the extractor 4 disposed in opposition thereto, an ion beam 5 of the liquid metal composition is emitted from the fore end of the needle tip 1. In such a liquid metal ion source, the condition under which the ion source operates stably is when the amount of the source material 2 outgoing from the fore end of the needle tip 1 in the form of the ion beam 5 balances the amount of inflow from the reservoir 3' of the source material 2 to the fore end. The outgoing amount of the source material 2 depends upon the value of an ion current to be extracted, while the inflow amount is affected by the viscosity and surface tension of the source material 2, the wettability thereof with the needle tip 1, forces exerted thereon by gravity and the extracting field, etc. Therefore, it is very difficult to establish the balance. Even when it is established, permissible conditions are very narrow in many cases. Any countermeasure has accordingly been desired.

SUMMARY OF THE INVENTION

It is accordingly an object of the present invention to provide a liquid metal ion source whose characteristics are very stable.

In order to accomplish the object, according to the present invention, a liquid metal ion source including an electrode with a fore end formed in the shape of a needle, a reservoir for holding a source material in a molten state, and an extractor for applying a high electric field to the fore end of the needle electrode wetted with the molten source material, thereby to extract ions of said material from said fore end; is so constructed that said needle electrode is disposed at a position spaced from said reservoir, and that means is disposed for varying a distance from said reservoir to said fore end of said needle electrode.

Owing to such characterizing construction of the present invention, the distance from the reservoir of the source material to the fore end of the needle electrode can be set at the optimum value, with the result that the provision of a liquid metal ion source of very stable operating characteristics becomes possible.

BRIEF DESCRIPTION OF THE DRAWINGS

FIG. 1 is a sectional constructional view of a prior-art liquid metal ion source, while

DETAILED DESCRIPTION

First, the principle of the present invention will be described. For satisfying the balance between the outgoing amount and inflow amount of a source material at the fore end of a needle tip under wide ranges of experimental conditions, it has been found effective to finely adjust the distance from a reservoir for the source material to the fore end of the needle tip outside a vacuum chamber and to set the distance at the optimum value. More specifically, when this distance is too long, the stream of the liquid source material from the reservoir toward the fore end of the needle tip becomes unstable and is sometimes interrupted halfway particularly in a case where the source material has a high melting point or where it has an inferior wettability with the surface of the needle tip. Conversely, when the distance is too short, the source material flows in more than is necessary, and the liquid metal rounds at the fore end of the needle tip on account of a surface tension, so that an electric field required for ion emission is not attained, and the ion emission stops. In the present invention, therefore, there is disposed a means capable of varying the distance from the reservoir of the source material to the fore end of the needle tip in order to optimize the distance on each occasion.

Figure 1:
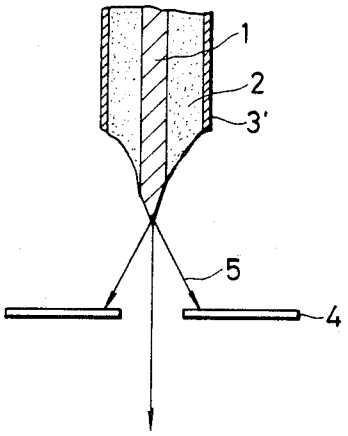
FIG. 1 PRIOR ART
Figure 2:
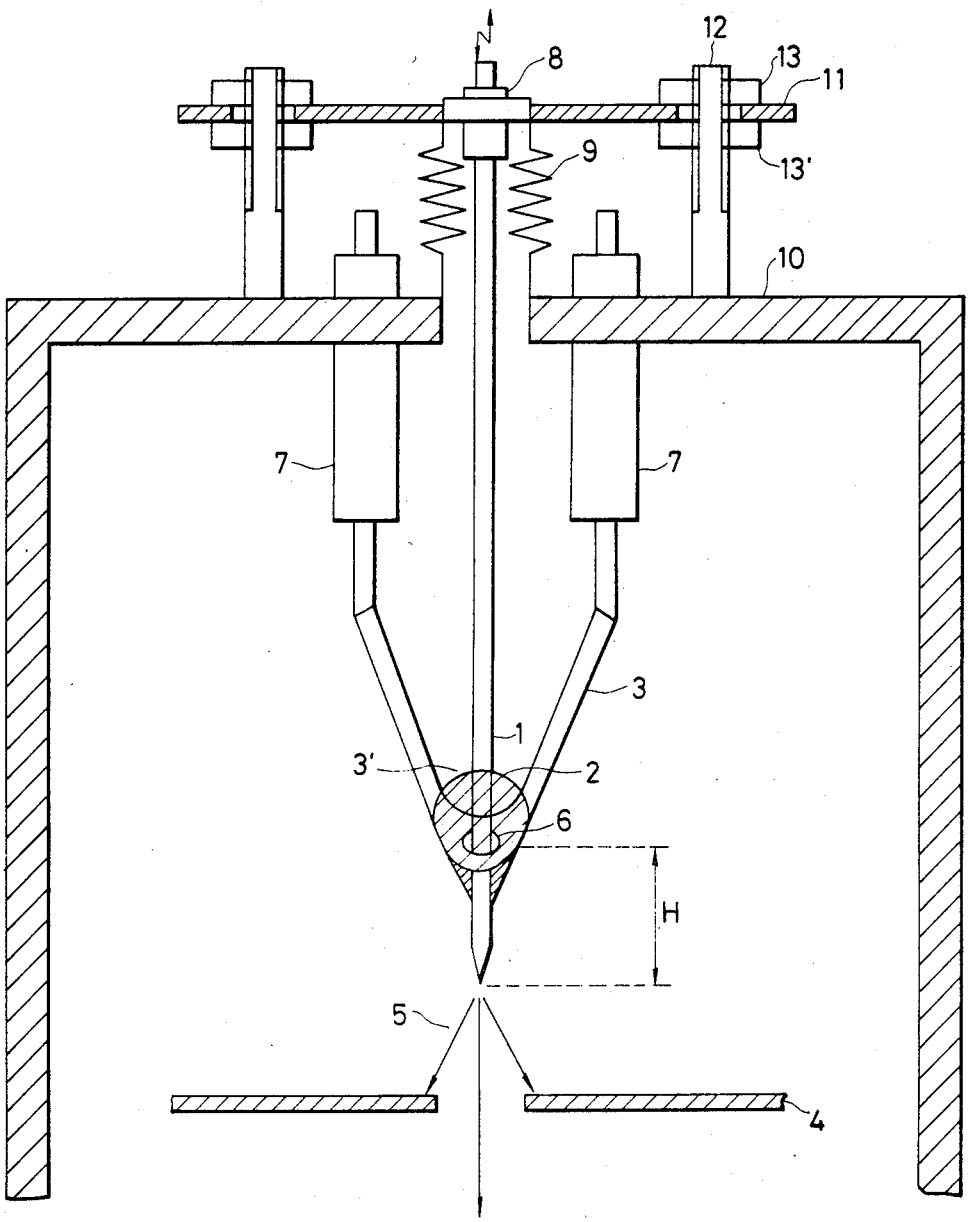
FIG. 2 is a sectional constructional view of a liquid metal ion source according to the present invention.

Now, an embodiment of a liquid metal ion source according to the present invention will be described with reference to FIG. 2. First, a ribbon-shaped sheet 3 made of molybdenum and having a width of 2 mm, a thickness of 50 μm and a length of 25 mm, the sheet becoming a reservoir 3' for a source material 2, is centrally provided with a hole 6 having a diameter of 0.8 mm, whereupon the sheet 3 is bent into the shape of letter V and then has both its ends mounted on electrodes 7, 7, thereby to form a heater. On the other hand, a needle tip 1 made of a tungsten wire 200 μm in diameter is passed through the hole 6 and has its one end mounted on an electrode 8, thereby to form a needle electrode. Here, gold (melting point: 1063° C.) was used as an example of the source material 2. About 80 mg of gold is placed on the V-shaped corner forming the reservoir 3' of the source material 2, and the ribbon-shaped sheet 3 having the reservoir 3', namely, the heater has its temperature raised to about 1100° C. by resistance heating, thereby to render the gold liquid. The needle tip 1 has its one end fixed to the electrode 8, which is connected to a vacuum chamber wall 10 through bellows 9. The electrode 8 is fixed to a metal sheet 11, and its height can be finely adjusted by rotating nuts 13, 13' which are held in threadable engagement with metal bolts 12 erected on the vacuum chamber wall 10 and having four fine threads cut therein. When, with the source material 2 held liquid, the distance H from the V-shaped corner of the reservoir 3' to the fore end of the needle tip 1 is adjusted to approximately 0.3 mm by loosening the nuts 13, 13' the fore end of the needle tip 1 dips in the liquid source material 2 having soaked out of the hole 6 of the reservoir 3' and gets wet entirely. Thereafter, the fore end of the needle tip 1 is protruded to approximately 1.5 mm from the reservoir 3' again, and it is supplied with a positive voltage of 7–8 kV with respect to an extractor 4. Then, the emission of ions 5 is started. In an example, the fluctuation of an ion current was as large as about 20–50%/10 minutes in the state left intact, but it could be reduced to 3–7%/10 minutes by finely adjusting the position of the fore end of the needle tip 1 again. The ion current at this time was approximately 40 μA. The value of the ion current could be varied in a range of 10–200 μA by adjusting the extraction voltage, and for each current value, the needle tip 1 was finely adjusted to optimize the distance H. As a result, the fluctuation of the ion current could be suppressed to 3–15%/10 minutes for the wide range of ion current values.

Owing to a liquid metal ion source according to the present invention which, as described above, is furnished with a tip moving mechanism capable of varying a distance from the reservoir of a source material to the fore end of a needle tip, it has become possible to produce a stable ion beam at all times, and it has become possible to achieve enhancement in the performance of an equipment provided with such ion source.

While the foregoing embodiment is an example in which the reservoir of the source material is formed by the use of the ribbon-shaped sheet, it has been confirmed that similar effects are attained even when it is in the shape of a pipe or a coil. Further, similar results have been produced even when substances other than gold have been employed as the source material.

We claim:

1. A liquid metal ion source comprising an electrode with a fore end formed in the shape of a needle, a reservoir for holding a source material to be ionized in a molten state, an extractor for applying a high electric field to the fore end of the needle electrode wetted with the molten source to extract ions of said source material from said fore end of said needle electrode, a vacuum chamber enveloping said reservoir, said extractor and at least the fore end of said electrode, and means for finely adjusting a distance between said reservoir and said fore end of said needle electrode from outside said vacuum chamber whereby the amount of the source material supplied from said reservoir to the fore end of said electrode can be balanced with the amount of the source material ionized from the fore end of said electrode.

2. A liquid metal ion source according to claim 1, wherein said reservoir is constructed of a ribbon-shaped heater which has a hole through which said needle electrode penetrates.

* * * * *